US005551455A

United States Patent [19]

Spatola

[11] Patent Number: 5,551,455

[45] Date of Patent: Sep. 3, 1996

[54] HAIR REPAIR KIT

[76] Inventor: Adelle Spatola, 347 Willowdale Ave., North York, Canada, M2N 5A3

[21] Appl. No.: 373,604

[22] Filed: Jan. 17, 1995

[51] Int. Cl.[6] ..... A45D 7/02

[52] U.S. Cl. ..... 132/212; 132/53; 132/294; 132/315; 206/581; 2/174

[58] Field of Search ..... 132/212, 53, 294, 132/315; 2/174; 206/223, 581

[56] References Cited

U.S. PATENT DOCUMENTS

| | | | |
|---|---|---|---|
| 3,594,915 | 7/1971 | Routledge | 132/212 |
| 4,506,783 | 3/1985 | Morganroth | 206/581 |
| 5,397,875 | 3/1995 | Bechtold | 132/315 |

*Primary Examiner*—Gene Mancene
*Assistant Examiner*—Pedro Philogene

[57] ABSTRACT

The present invention provides a new and improved kit for use in conjunction with a hair conditioning treatment. The kit includes a container having an opened top, a closed bottom, four sidewalls, an inner surface and an outer surface, and a cover hingedly attached to the open top. There are at least two receiving areas: a plastic cap receiving area defined upon the inner surface, and a cotton strip receiving area defined upon the inner surface. A plurality of plastic caps are included in the kit. Each of the plastic caps has a closed top and opened bottom, and a peripheral edge defining the opened bottom. Each of the caps is adapted to be worn upon the head of the user, furthermore each of the plastic caps is stacked one upon the other and positioned within the plastic cap receiving area of the container. A number of cotton strips are also included in the kit. Each cotton strip is of substantially similar dimensions and is adapted to encircle the scalp of a user. The cotton strips are adapted to be positioned within the cotton strip receiving area of the container. A paper sleeve having a first end, a second end, an intermediate extent, an inner surface and an outer surface, is adapted to be secured about the cotton strips. The paper sleeve and the cotton strips are adapted to be positioned within the cotton strip receiving area of the container.

3 Claims, 3 Drawing Sheets

HAIR REPAIR KIT

BACKGROUND OF THE INVENTION

1. Field of the Invention

The present invention relates to a hair repair kit and more particularly pertains to a kit with hair treatment components therein.

2. Description of the Prior Art

The use of hair caps is known in the prior art. More specifically, hair caps heretofore devised and utilized for the purpose of maintaining hair permanents are known to consist basically of familiar, expected, and obvious structural configurations, notwithstanding the myriad of designs encompassed by the crowded prior art which has been developed for the fulfillment of countless objectives and requirements.

For example, U.S. Pat. No. 5,079,777 to Fowler et al. discloses a top cover accessory to be worn about the neck during hair dressing.

U.S. Pat. No. 4,914,754 to Ruth discloses a disposable cap and cape for chemical processing of hair.

U.S. Pat. No. 4,683,596 to Cole discloses a curl keeping hair cap.

U.S. Pat. No. 4,386,619 to Williams discloses a hair-enhancing cap.

U.S. Pat. No. 4,289,150 to Kimball discloses a protective cover and method for treating hair.

Finally, U.S. Pat. No. 4,958,385 to Rushton, Jr. discloses a hairdressing headband.

In this respect, the hair repair kit according to the present invention substantially departs from the conventional concepts and designs of the prior art, and in doing so provides an apparatus primarily developed for the purpose of providing hair treating components in a kit.

Therefore, it can be appreciated that there exists a continuing need for a new and improved hair repair kit which can be used for keeping various hair treatment components together. In this regard, the present invention substantially fulfills this need.

SUMMARY OF THE INVENTION

In view of the foregoing disadvantages inherent in the known types of hair caps now present in the prior art, the present invention provides an improved hair repair kit. As such, the general purpose of the present invention, which will be described subsequently in greater detail, is to provide a new and improved hair repair kit and method which has all the advantages of the prior art and none of the disadvantages.

To attain this, the present invention essentially comprises a kit for use in conjunction with a hair conditioning treatment. The kit includes a container having an opened top, a closed bottom, four sidewalls, an inner surface and an outer surface, and a cover hingedly attached to the open top. There are several receiving areas: a plastic cap receiving area defined upon the inner surface; a cotton strip receiving area defined upon the inner surface; and a hair treatment receiving area defined upon the inner surface. There are three plastic caps, each of the plastic caps having a closed top and opened bottom with a peripheral edge defining the opened bottom. Each of the caps is adapted to be worn upon the head of the user. Each of the caps is adapted to be flattened and folded such as to attain a wedge shaped configuration. Each of the folded wedge shaped plastic caps is then stacked one upon the other and positioned within the plastic cap receiving area of the container. The kit also includes a first, second and third cotton strip. Each cotton strip is of substantially similar dimensions and is adapted to encircle the scalp of a user. The first, second and third cotton strips are adapted to be positioned in a nested configuration. The nested configuration is defined by the first cotton strip being positioned in the shape of an elongated loop, with the area within the elongated loop of the first cotton strip defining a first inner area, the second cotton strip being positioned in an elongated loop and placed within the first inner area, the area within the elongated loop of the second cotton strip defining a second inner area, and the third cotton strip being positioned in an elongated loop and placed within the second inner area. A paper sleeve having a first end, a second end, an intermediate extent, an inner surface and an outer surface, with means for securing the first end to the second end, is adapted to be secured about the first, second and third cotton strips in the nested configuration. The paper sleeve and the first, second and third cotton strips are adapted to be positioned within the cotton strip receiving area of the container. A second container which is adapted to hold an amount of hair treatment fluid is included in the kit. The second container is adapted to be positioned within the hair treatment receiving area of the container.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair repair kit which has all the advantages of the prior art hair caps and none of the disadvantages.

It is another object of the present invention to provide a new and improved hair repair kit which may be easily and efficiently manufactured and marketed.

It is further object of the present invention to provide a new and improved hair repair kit which is of durable and reliable constructions.

An even further object of the present invention is to provide a new and improved hair repair kit which is susceptible of a low cost of manufacture with regard to both materials and labor, and which accordingly is then susceptible of low prices of sale to the consuming public, thereby making such hair repair kit economically available to the buying public.

Still yet another object of the present invention is to provide a new and improved hair repair kit which provides in the apparatuses and methods of the prior art some of the advantages thereof, while simultaneously overcoming some of the disadvantages normally associated therewith.

Even still another object of the present invention is to provide hair treatment components in a kit.

Lastly, it is an object of the present invention to provide a new and improved kit for use in conjunction with a hair conditioning treatment. The kit includes a container having an opened top, a closed bottom, four sidewalls, an inner surface and an outer surface, and a cover hingedly attached to the open top. There are at least two receiving areas: a plastic cap receiving area defined upon the inner surface, and a cotton strip receiving area defined upon the inner surface. A plurality of plastic caps are included in the kit. Each of the plastic caps has a closed top and opened bottom, and a peripheral edge defining the opened bottom. Each of the caps is adapted to be worn upon the head of the user. Furthermore, each of the plastic caps is stacked one upon the other and positioned within the plastic cap receiving area of the container. A number of cotton strips are also included in the kit. Each cotton strip is of substantially similar dimensions and is adapted to encircle the scalp of a user. The cotton strips are adapted to be positioned within the cotton strip receiving area of the container. A paper sleeve having a first end, a second end, an intermediate extent, an inner surface and an outer surface, is adapted to be secured about the cotton strips. The paper sleeve and the cotton strips are adapted to be positioned within the cotton strip receiving area of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
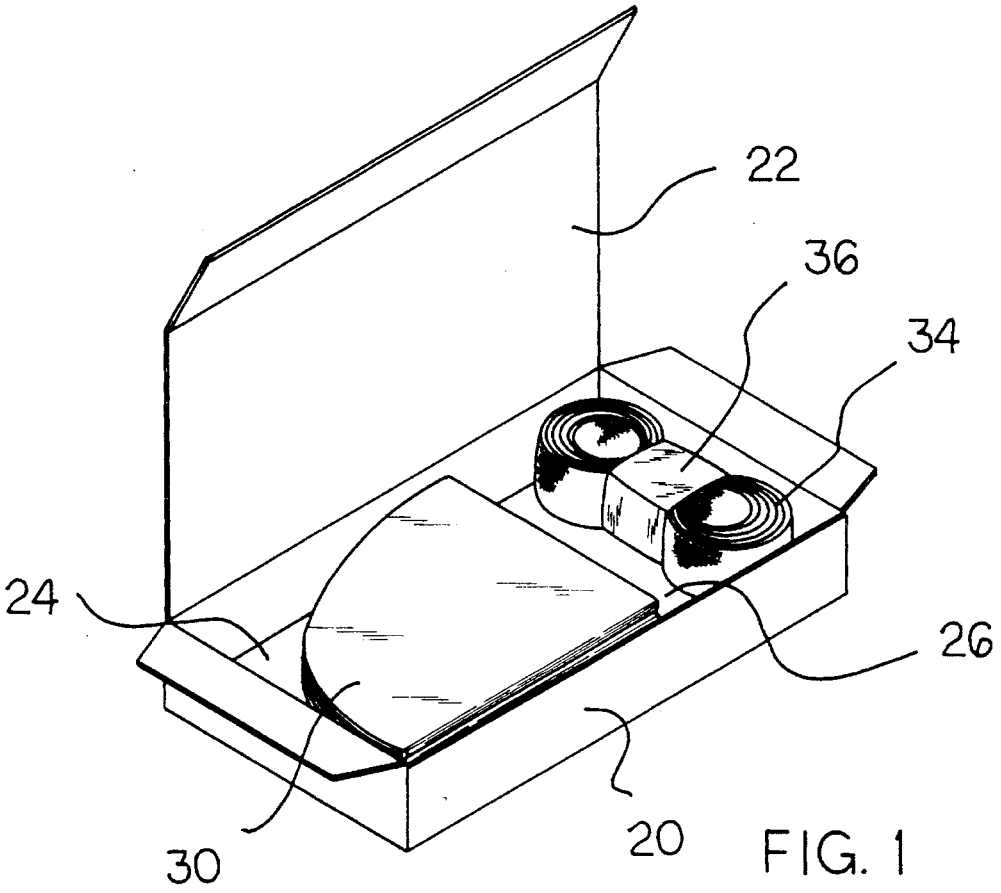
FIG. 1 is a perspective view of the preferred embodiment of the hair repair kit constructed in accordance with the principles of the present invention.
Figure 2:
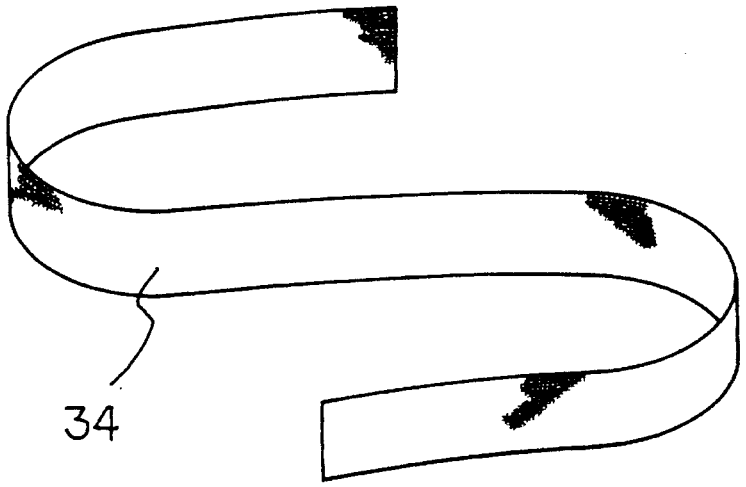
FIG. 2 is a view of one of the cotton strips of the kit.
Figure 3:
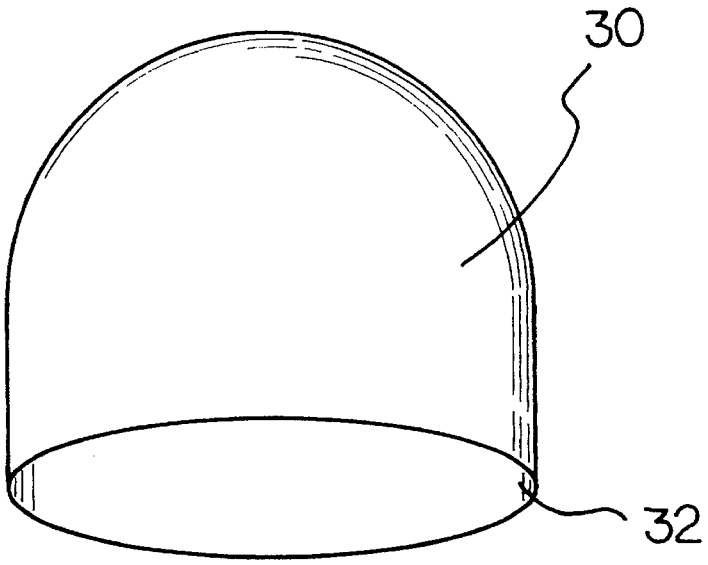
FIG. 3 is a view of one of the plastic caps used in the kit.
Figure 4:
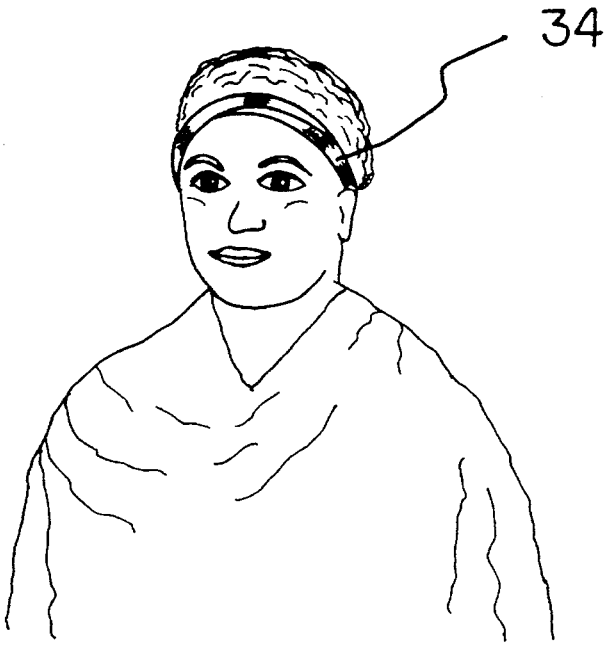
FIG. 4 is a view of one of the cotton strips in use.
Figure 5:
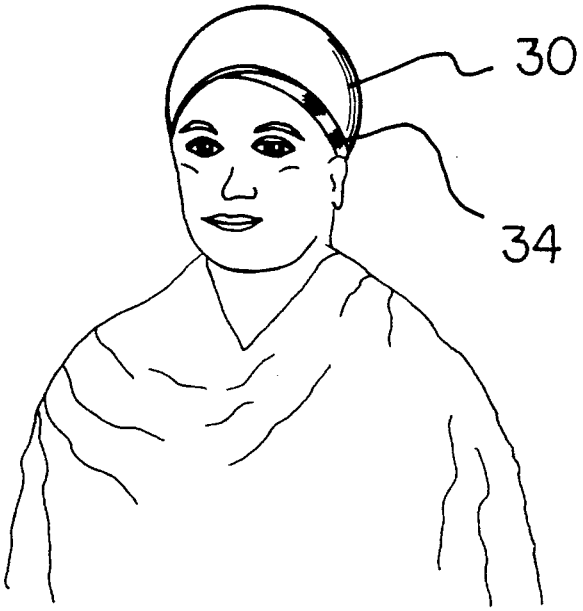
FIG. 5 is a view of one of the plastic caps in use.
Figure 6:
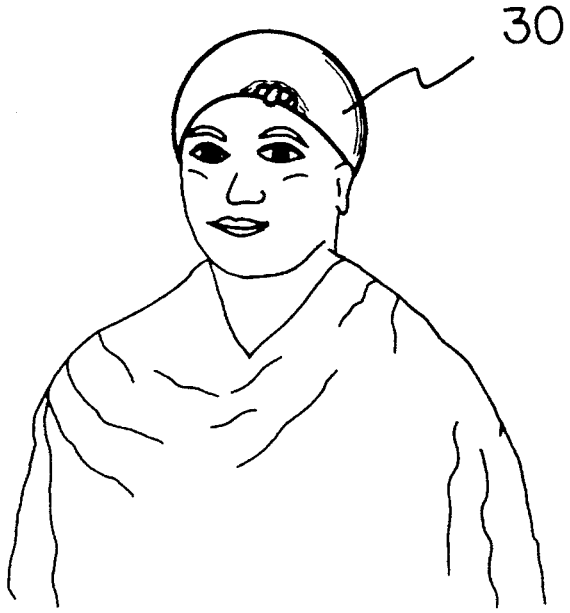
FIG. 6 is a view of one of the plastic caps in use with the excess perimeter taken up.

With reference now to the drawings, and in particular to FIG. 1 thereof, the preferred embodiment of the new and improved hair repair kit embodying the principles and concepts of the present invention will be described.

The present invention relates to a kit for use in treating hair. Furthermore, the present invention relates to a method of using the kit. In its broadest context, the present invention includes a container 20 for use in enclosing the entire kit, a number of cotton strips 34 positioned within the container and a number of plastic caps 30 positioned within the container. The various components of the present invention, and the method of using them, will be described in greater detail hereinafter.

The container 20 utilized in the present invention includes an opened top, a closed bottom, four sidewalls, an inner surface and an outer surface. A cover 22 is hingedly attached to the open top and serves to selectively cover the contents of the container 20. There are three specific areas defined within the interior of the container 20. Namely, a plastic cap receiving area 24 defined upon the inner surface, a cotton strip receiving area 26 defined upon the inner surface, and a hair treatment receiving area defined upon the inner surface. However, in the preferred embodiment of the present invention, the hair treatment receiving area 28 is not included. The construction of the container 20 can be standard, and the material employed in its construction can be any rigid sturdy material such as cardboard.

In the preferred embodiment three plastic caps 30 are stored within the container 20. However, although three are specified in the preferred embodiment any number of caps can be utilized in conjunction with the kit of the present invention. The three plastic caps 30 of the preferred embodiment each have a closed top, opened bottom, and a peripheral edge 32 defining the opened bottom. Furthermore, each of the caps is adapted to be worn upon the head of the user in conjunction with a hair treatment operation. For storage within the container 20 each of the caps is flattened and folded such as to attain a wedge shaped configuration. Then each of folded wedge shaped plastic caps are stacked one upon the other and positioned within the plastic cap receiving area 24 of the container 20.

A number of cotton strips 34 are also stored within the container 20 of the present invention. As with the caps, any number of cotton strips 34 can be employed in conjunction with the present invention, however there are three in the preferred embodiment. Each cotton strip is of substantially similar dimensions and adapted to encircle the scalp of a user in a hair treatment application. The first, second and third cotton strips are stored in a nested configuration. Specifically, the nested configuration is defined by the first cotton strip being positioned in the shape of an elongated loop, with the area within the elongated loop of the first cotton strip defining a first inner area. The second cotton strip is positioned in an elongated loop and placed within the first inner area. The area within the elongated loop of the second cotton strip defining a second inner area, and the third cotton strip being positioned in an elongated loop and placed within the second inner area. This positioning of adjacent cotton strips 34 defines the nested configuration.

A paper sleeve 36 is employed in securing the cotton strips 34. The paper sleeve 36 has a first end, a second end, an intermediate extent, an inner surface and an outer surface. Furthermore, means for securing are included for use in securing the first end to the second end. This means for securing can take of form of an adhesive. The paper sleeve 36 is adapted to be secured about the first, second and third cotton strips 34 in the nested configuration. The paper sleeve 36 and the first, second and third cotton strips 34 are adapted to be positioned within the cotton strip receiving area 26 of the container 20.

In an alternative embodiment of the present invention a second container is included with is adapted to hold an amount of hair treatment fluid. The second container is adapted to be positioned within the hair treatment receiving area of the container.

The method of utilizing the present invention is as follows. First the conditioning fluid is applied to the hair of the user. Secondly, one of the cotton strips 34 is wrapped around the head of a user approximately at the hair line. Then, lastly the plastic cap is secured over the head of the user. In order to ensure a tight fit of the cap, the excess perimeter of the cap can be taken and twisted to shorten the perimeter area of the cap. This excess, twisted perimeter area of the cap can then be tucked under the cap itself.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A kit for use in conjunction with a hair conditioning treatment, the kit comprising:

a container having an opened top, a closed bottom, four sidewalls, an inner surface and an outer surface, and a cover hingedly attached to the open top, a plastic cap receiving area defined upon the inner surface, a cotton strip receiving area defined upon the inner surface;

a plurality of plastic caps, each of the plastic caps having a closed top and opened bottom, a peripheral edge defining the opened bottom, each of the caps adapted to be worn upon the head of the user, each of the plastic caps being stacked one upon the other and positioned within the plastic cap receiving area of the container;

a number of cotton strips, each cotton strip being of substantially similar dimensions and adapted to encircle the scalp of a user, the cotton strips adapted to be positioned within the cotton strip receiving area of the container; and a paper sleeve having a first end, a second end, an intermediate extent, an inner surface and an outer surface, the paper sleeve adapted to be secured about the cotton strips, the paper sleeve and the cotton strips adapted to be positioned within the cotton strip receiving area of the container.

2. The kit as described in claim 1 wherein:

the number of plastic caps is three and each of the caps is flattened and folded such as to attain a wedge shaped configuration, each of folded wedge shaped plastic caps being stacked one upon the other and positioned within the plastic cap receiving area of the container.

3. The kit as described in claim 1 wherein:

the kit includes first, second and third cotton strips, and the strips are positioned in a nested configuration, the nested configuration being defined by the first cotton strip positioned in the shape of an elongated loop, the area within the elongated loop of the first cotton strip defining a first inner area, the second cotton strip being positioned in an elongated loop and placed within the first inner area, the area within the elongated loop of the second cotton strip defining a second inner area, the third cotton strip being positioned in an elongated loop and placed within the second inner area.

* * * * *